US010413078B2

(12) United States Patent
Lu

(10) Patent No.: US 10,413,078 B2
(45) Date of Patent: Sep. 17, 2019

(54) HEADREST ADJUSTING DEVICE

(71) Applicant: Dongguan Weihong Hardware and Plastic Products Co., Ltd., Dongguan (CN)

(72) Inventor: Wei Lu, Dongguan (CN)

(73) Assignee: DONGGUAN WEIHONG HARDWARE AND PLASTIC PRODUCTS CO., LTD., Dongguan (CN)

( * ) Notice: Subject to any disclaimer, the term of this patent is extended or adjusted under 35 U.S.C. 154(b) by 0 days.

(21) Appl. No.: 15/894,692

(22) Filed: Feb. 12, 2018

(65) Prior Publication Data

US 2019/0090649 A1 Mar. 28, 2019

(30) Foreign Application Priority Data

Sep. 27, 2017 (CN) ..... 2017 1 0892660

(51) Int. Cl.
*A47C 20/04* (2006.01)
*A47C 7/38* (2006.01)

(52) U.S. Cl.
CPC ..... *A47C 20/046* (2013.01); *A47C 7/38* (2013.01)

(58) Field of Classification Search
CPC ..... B60N 2/809; B60N 2/829; B60N 2/847; A47C 7/38; A47C 20/046
USPC ..... 297/410, 408
See application file for complete search history.

(56) References Cited

U.S. PATENT DOCUMENTS 6,270,161 B1 * 8/2001 De Filippo ..... B60N 2/838 297/410
8,801,103 B2 * 8/2014 Bittinger ..... B60N 2/874 297/391
8,814,270 B2 * 8/2014 Adams ..... B60N 2/859 297/408

FOREIGN PATENT DOCUMENTS

EP 3100644 A1 * 12/2016 ..... A47C 7/38

* cited by examiner

*Primary Examiner* — Milton Nelson, Jr.
(74) *Attorney, Agent, or Firm* — Shimokaji IP

(57) ABSTRACT

A headrest adjusting device includes a hinge, a fixed base and a drive device. The drive device is fixed on the fixed base and has an output end that is capable of sliding upwards or downwards, the hinge comprises a first rod and a second rod which are pivotally connected together, the second rod can be rotated or locked relatively to the first rod, and the first rod is driven by the output end of the drive device to move upwards or downwards. By the headrest adjusting device, the angle and the height of the headrest can be adjusted independently, thereby meeting demands of the users. Additionally, the hinge and the drive device can be adjusted at the same time, to simultaneously adjust the angle and the height of the headrest.

9 Claims, 11 Drawing Sheets

HEADREST ADJUSTING DEVICE

RELATED APPLICATIONS

This application claims the benefit of priority to Chinese Patent Application No. 201710892660.9 filed on Sep. 27, 2017, which is hereby incorporated by reference in its entirety.

FIELD OF THE INVENTION

The present invention relates to an internal support structure in furniture, more particularly to a headrest adjusting device.

BACKGROUND OF THE INVENTION

Generally, angles of a headrest of a sofa can be adjusted to improve comfort. One of the achievement manners is to set an adjuster having a pivotal joint in the sofa. The current adjuster mainly includes two types, one of which is a hinge to merely adjust the angle of the headrest, another of which is a linkage mechanism with hinges to fine adjust the height of the headrest during the angle adjusting, so as to prevent wrinkles or extensions generated on the sofa surface.

During actual using, user may respectively adjust the height or the angle of the headrest, for example, only adjusts the height rather than the angle, but the current adjuster cannot meet such a demand.

Thus it's necessary to provide an adjusting device for respectively adjusting the angle and the height of the headrest.

SUMMARY OF THE INVENTION

One objective of the present invention is to provide an adjusting device for respectively adjusting the angle and the height of the headrest.

To achieve the above objective, a headrest adjusting device of the present invention includes a hinge, a fixed base and a drive device. The drive device is fixed on the fixed base and has an output end that is capable of sliding upwards or downwards, the hinge comprises a first rod and a second rod which are pivotally connected together, the second rod can be rotated or locked relatively to the first rod, and the first rod is driven by the output end of the drive device to move upwards or downwards.

In comparison with the prior arts, the drive device with an output end is configured on the fixed base of the headrest adjusting device according to the present invention, the first rod of the hinge is connected with the output end of the drive device, during the assembly, the fixed base is fixed into the sofa body, and the two second rods are fixed to the sofa body. If there is a need to separately adjust the angle of the headrest, it can be achieved by adjusting the angle between the second rod and the first rod; if there is a need to separately adjust the height of the headrest, it can be achieved by lifting or reducing the position of the hinge. Additionally, the hinge and the drive device can be adjusted at the same time, to simultaneously adjust the angle and the height of the headrest. By this token, by means of the headrest adjusting device according to the present invention, the angle and the height of the headrest can be adjusted independently, thereby meeting demands of the users.

Preferably, a locking member and an elastic member are arranged between the first rod and the second rod, a positioning hole is provided at one end of the first rod, the positioning hole comprises a first tooth surface and a contact surface connected with the first tooth surface, the first tooth surface is in arc-shaped, a receiving hole is provided at one end of the second rod, the receiving hole comprises a first receiving hole and a second receiving hole which are communicated with one another, and a positioning slot is formed at one end of the first receiving area; the locking member comprises a retaining portion and a locking portion, the retaining portion is detachably inserted into the positioning slot to make the locking portion to swing in the first receiving area, the locking portion includes a second tooth surface extended into the positioning hole to engage with the first tooth surface, one end of the elastic member is received in the second receiving area, another end of the elastic member is pushed against the locking portion to the first tooth surface; an unlocking position is formed at a connection between the first receiving area and the second receiving area, and one end of the locking portion is pushed by the contact surface to slide into the unlocking position thereby disengaging the first tooth surface from the second tooth surface.

Preferably, the locking portion is wedge-shaped, and the retaining portion is fixed on one end of the locking portion.

Preferably, the second receiving area is circular, the elastic member is a leaf spring which has one end that is curved and received in the second receiving area and another end that is straight and extended into the first receiving area to push the locking member.

Preferably, a power spring is arranged between the first rod and the second rod, and the power spring pulls the second rod to rotate relatively to the first rod once the power spring is disengaged from the first tooth surface and the second tooth surface.

Preferably, the device further includes a lift mechanism fixed to the output end of the drive device, and one end of the first rod is installed on the lift mechanism.

Preferably, the fixed base includes a vertical guide stein, and a linear bearing is fixed on the lift mechanism and sleeved the vertical guide stein.

Preferably, a plug bush is formed on the lift mechanism, and one end of the first rod is detachably inserted into the lift mechanism.

Preferably, the lift mechanism is provided with a screw hole located above the plug bush, and a screw nut is provided at the first rod to connect with the screw hole and press against the plug bush.

Preferably, the device further includes two said hinges, and two side first rods of the hinges are respectively installed on two ends of the lift mechanism.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
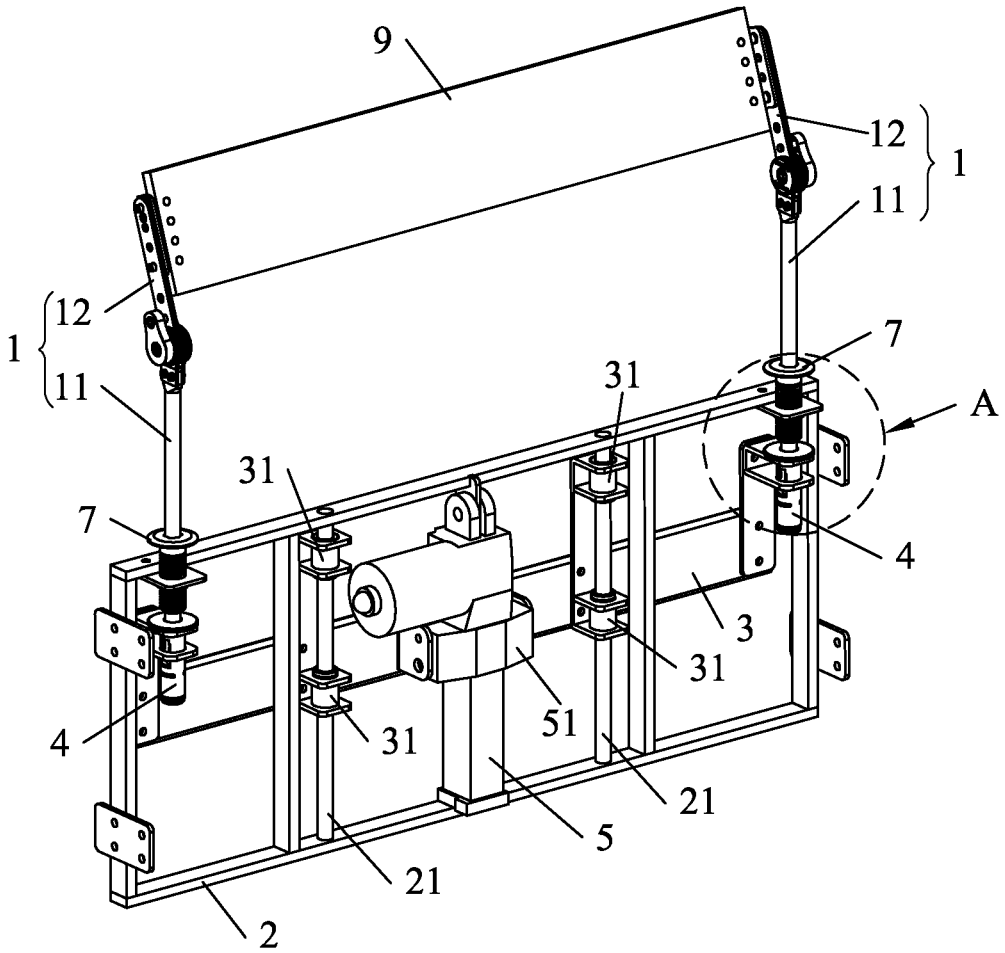
FIG. 1 is a perspective view of an adjusting device according to one embodiment of the present invention.

As illustrated in FIG. 1, a headrest adjusting device according to one embodiment of the present invention is applicable to install in a sofa to adjust the angle and height of the headrest relatively to the sofa body. The headrest adjusting device includes a hinge 1, a fixed base 2 and a drive device. Specifically, the fixed base 2 is fixed inside the sofa body, the drive device is installed on the fixed base 2 and has an output end that is capable of sliding upwards or downwards, and the hinge 1 includes a first rod 11 and a second rod 12 pivotally connected together. More specifically, the second rod 12 can be rotated or locked relatively to the first rod 11, the first rod 11 is driven by the output end of the drive device to move upwards or downwards, and the second rod 12 is fixed inside the headrest.

The headrest adjusting device further includes a lift mechanism 3 and two plug bushes 4, and the quantity of the hinge 1 is two. The drive device is an electric push rod 5, and a slider 51 of the electric push rod 5 is the output end of the drive device. The fixed base 2 includes several cross bars and vertical bars connected together to form a rectangle. Specifically, the fixed base 2 includes two vertical guide stems 21 between which the electric push rod 5 is set. The lift mechanism 3 is located at a side of the fixed base 2, four linear bearings 31 are fixed on the lift mechanism 3 and two of which are sleeved on each vertical guide stein 21, so that the lift mechanism 3 can stably slide along the fixed base 2 upwards or downwards. As shown, the lift mechanism 3 is fixed to and under controlled by the slider 51 of the electric push rod 5 to lift or fall. The two plug bushes 4 are configured at two ends of the lift mechanism 3, and the lower end of the first rod 11 of the hinge 1 is inserted into the plug bush 4, so that the position of the hinge can be lifted or reduced if the lift mechanism 3 is sliding upwards or downwards relatively to the fixed base 2. Additionally, a mounting plate 9 is connected between the two rods 12 of the hinges 1, thereby benefiting to connect with the headrest and enhancing the support strength of the headrest.

It should be noted that, the hinge 1 and the lift mechanism 3 in the present invention are two independent mechanisms. That is, the height of the lift mechanism 3 and the relative angle of the first rod 11 and the second rod 12 can be adjusted independently, without depending on each other. Detailed descriptions follow.

Figure 2:
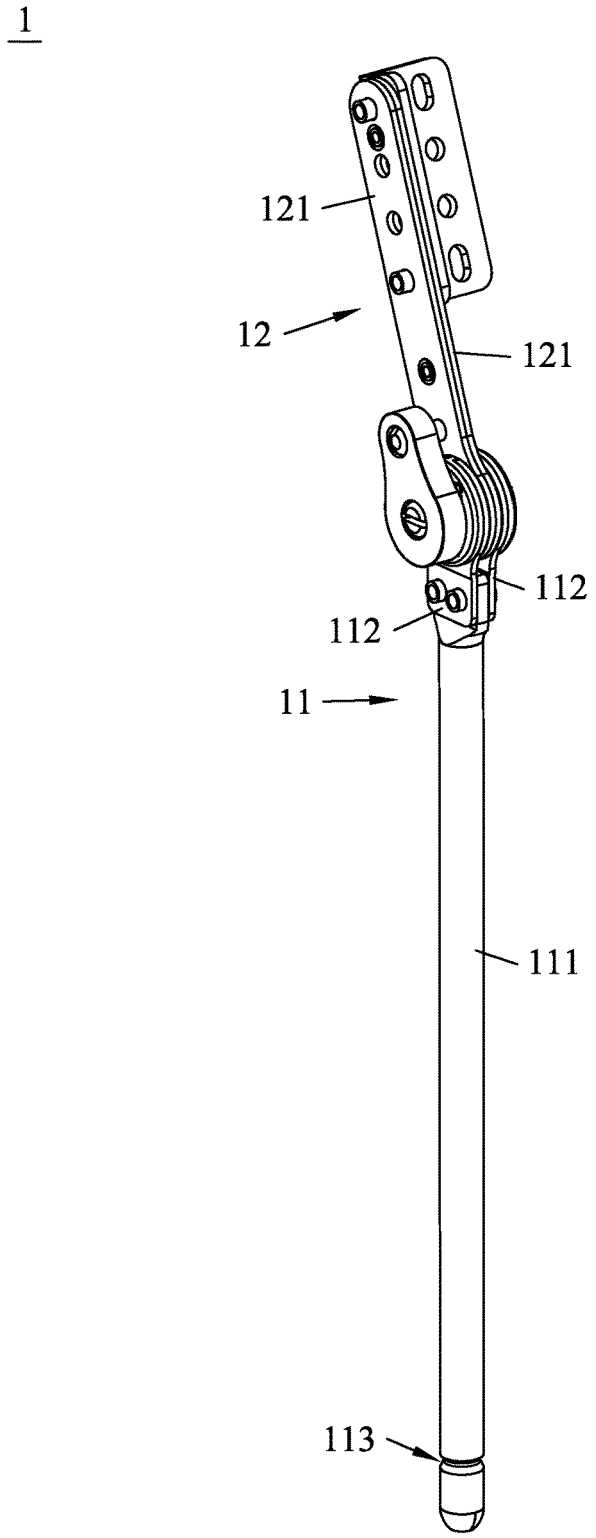
FIG. 2 is a perspective view of a hinge o the adjusting device according to one embodiment of the present invention.
Figure 3:
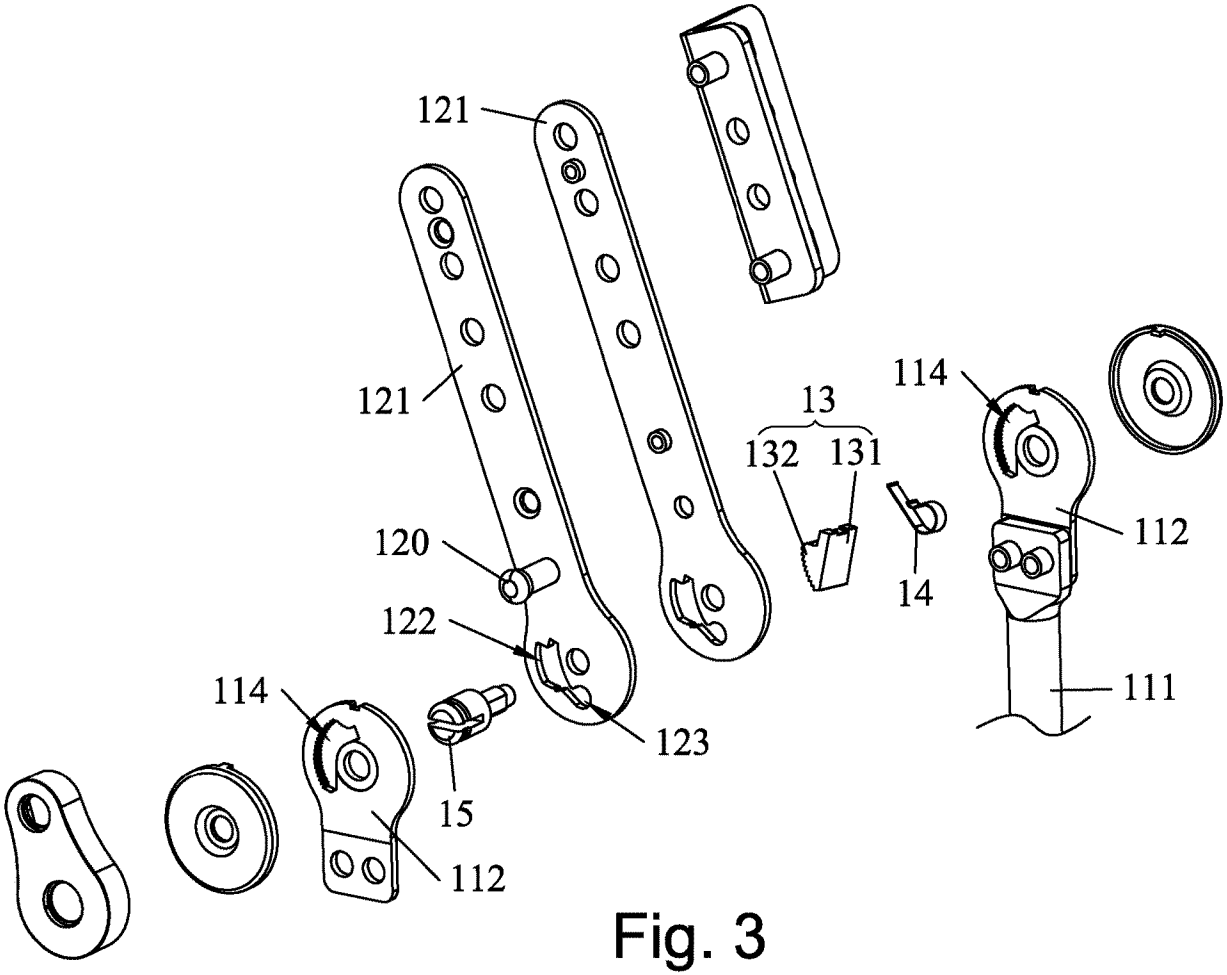
FIG. 3 is an exploded view of the hinge.

As shown in FIGS. 2-3, the hinge 1 includes a locking member 13 and an elastic member 14 arranged between the first rod 11 and the second rod 12. The first rod 11 is pivotally connected to the second rod 12 by means of a pivot 15. Specifically, the first rod 11 includes a straight rod 111 and two retaining members 112 fixed on one end of the straight rod 111; the second rod 12 includes two flake-like straight bars 121 that are attached together and clamped and retained by the two retaining members 112. Preferably, the structures of the retaining members 112 are the same, and the structures of the straight bars 121 are the same as well. In this embodiment, the first rod 11 and the second rod 12 are formed by two connecting members respectively, so as to enhance the transverse strength of the hinge 1 thereby improving support force of the headrest. A retaining ring groove 113 is formed at another end of the straight rod 111 of the first rod 11.

Figure 4:
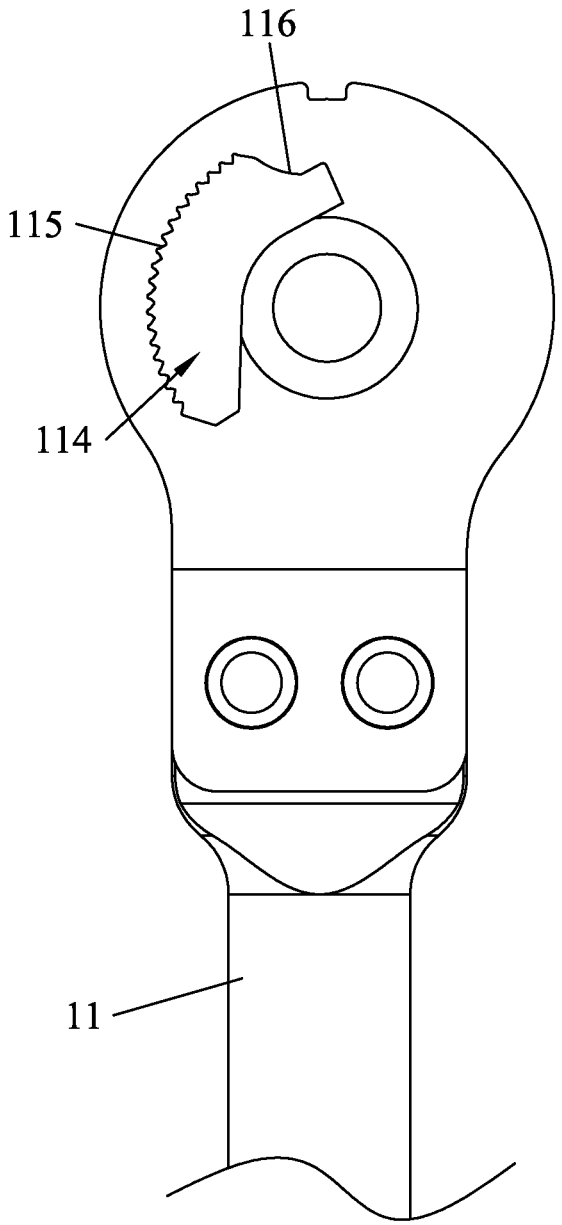
FIG. 4 is a partial view of a first rod, showing a positioning hole thereon.

As shown in FIG. 4, a positioning hole 114 is provided at one end of the first rod 11 where is pivotally connected with the second rod 12, and the positioning hole 114 includes a first tooth surface 115 and a contact surface 116 connected with the first tooth surface 115. Specifically, the first tooth surface 115 is curved and in arc-shaped, and the contact surface 116 is curved. That is, the whole of the positioning hole 114 is in arc-shaped, and the side wall opposite to the first tooth surface 115 is in arc-shaped as well.

Figure 5:
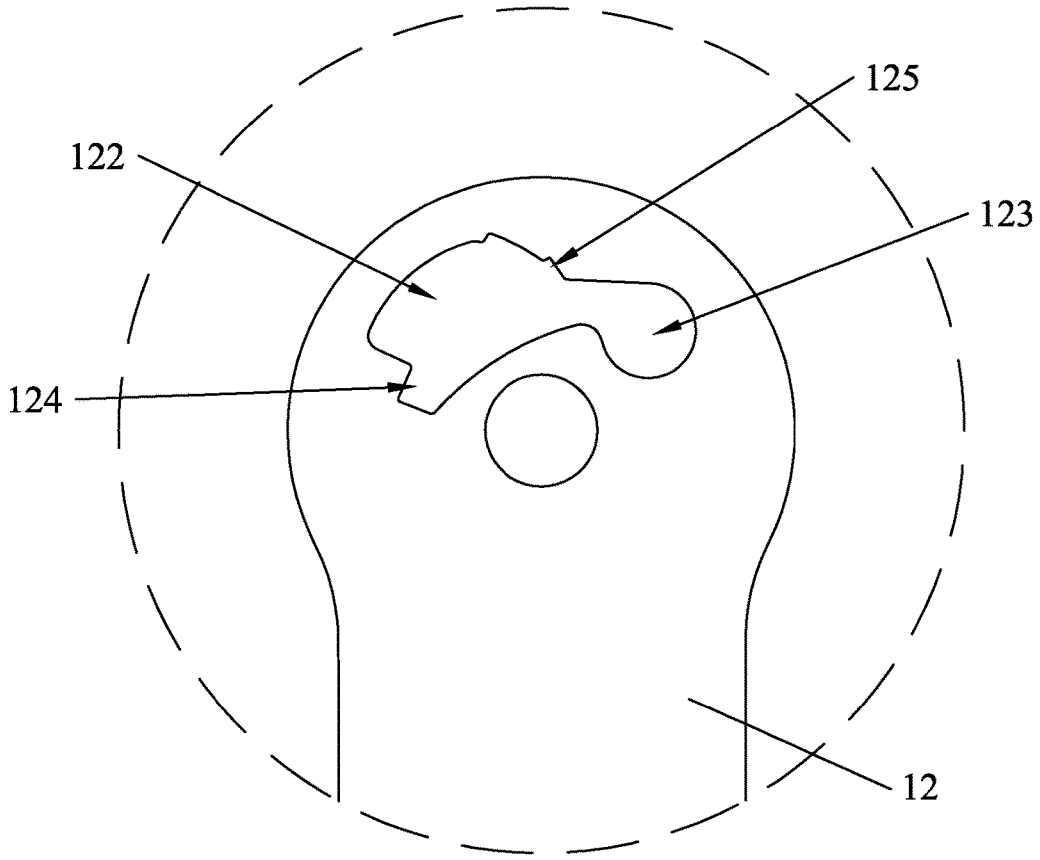
FIG. 5 is a partial view of a second rod, showing a receiving hole thereon.

As illustrated in FIG. 5, a receiving hole is provided at one end of the second rod 12 where is pivotally connected with the first rod 11. The receiving hole includes a first receiving area 122 and a second receiving area 123 that are communicated with each other. Preferably, the second receiving area 123 is approximately circular, and a positioning slot 124 is formed at one end of the first receiving area 122. Further, the connection between the first receiving area 122 and the second receiving area 123 is provided with an unlocking position 125 that is recessed.

Figure 6:
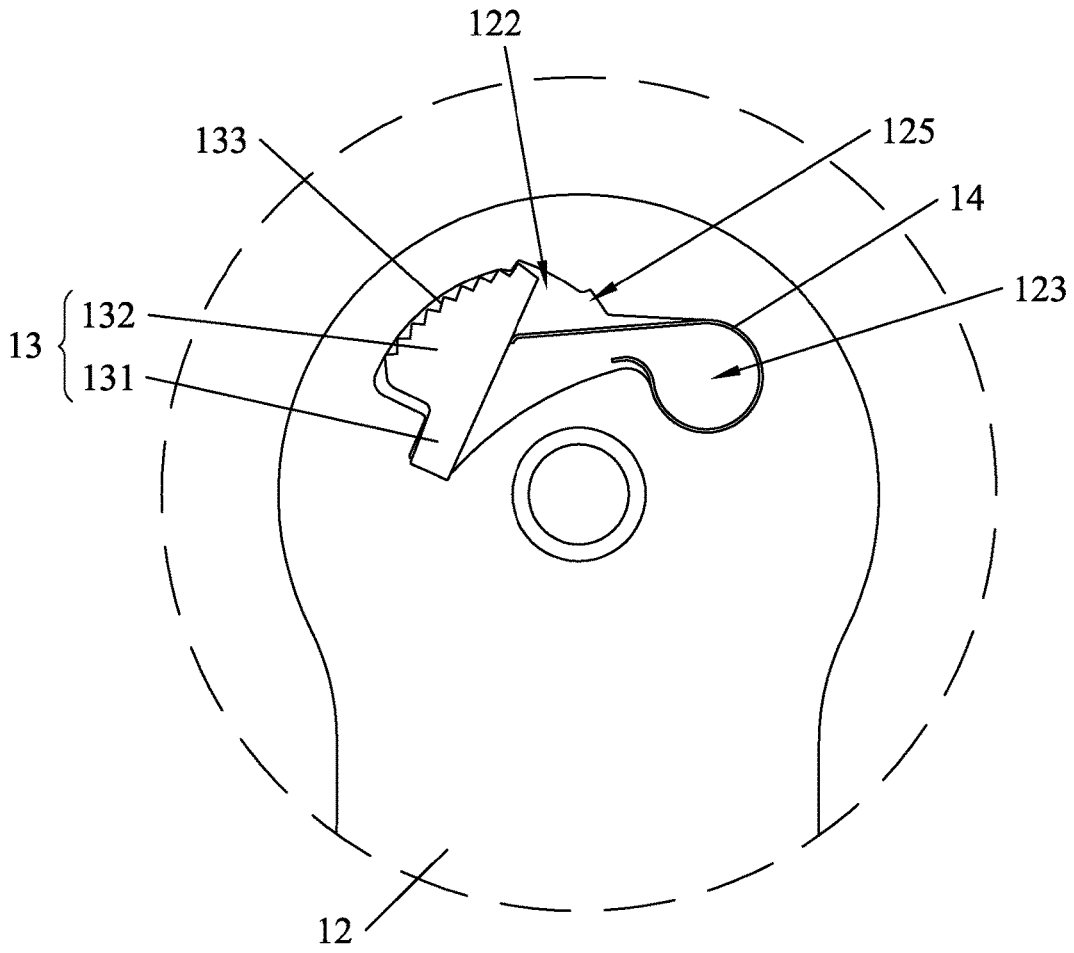
FIG. 6 shows that a locking member and an elastic member are arranged in the receiving hole.

Referring to FIG. 6, the locking member 13 includes a retaining portion 131 and a locking portion 132 which is wedge-shaped, and the retaining portion 131 is fixed on one end of the locking portion 132. Preferably, the retaining portion 131 and the locking portion 132 are integrated in unity structure. Specifically, a second tooth surface 133 is formed on the locking portion 132, the retaining portion 131 is movably inserted into the positioning slot 124 so that the locking portion 132 can swing in the first receiving area 122, and the upper end of the locking portion 132 can be slid into the unlocking position 125. Preferably, the elastic member 14 is a leaf spring which has one end that is curved and received in the second receiving area 123 and another end that is straight and extended into the first receiving area 122 to push the locking portion 132 of the locking member 13 where is opposite the second tooth surface 133.

Figure 7:
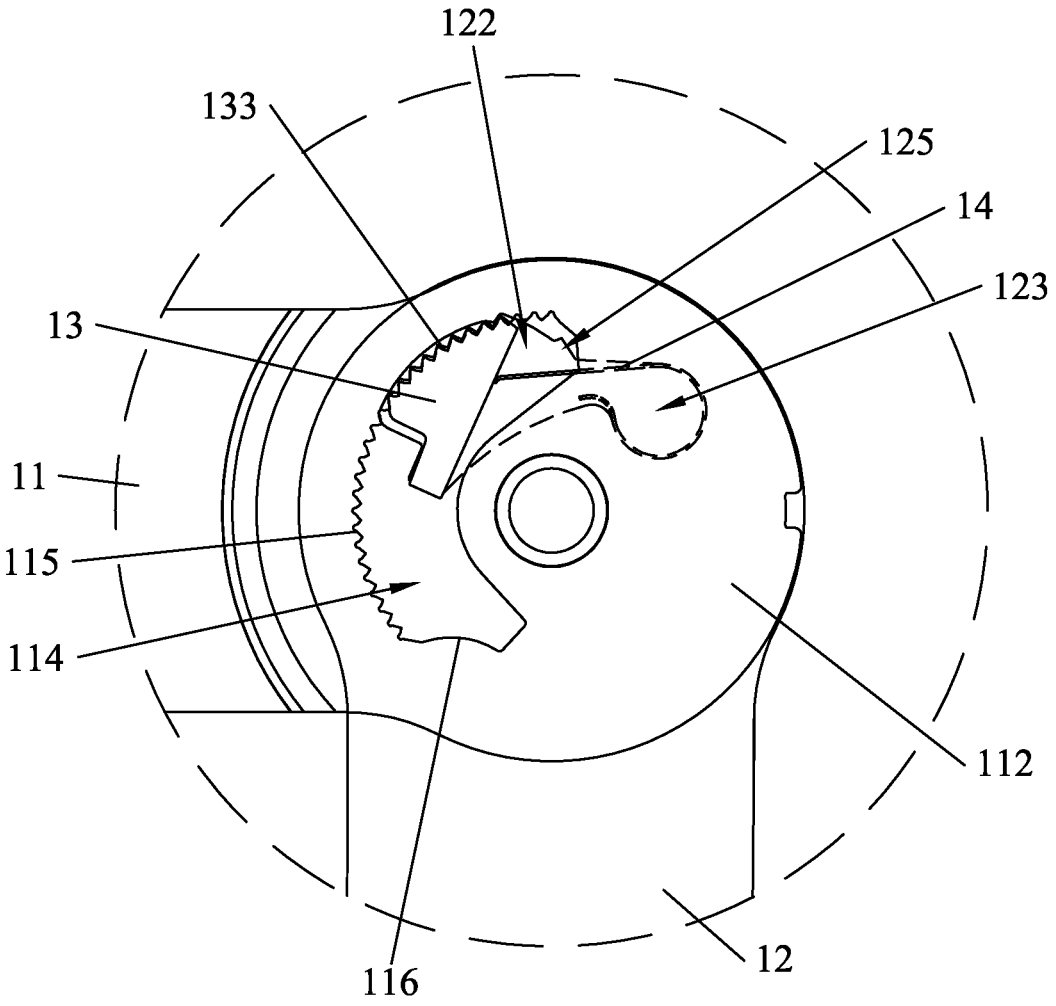
FIG. 7 shows an engaging view of the first rod and the second rod.

Now turning to FIGS. 3 and 7, the thickness of the elastic member 14 is equal to or smaller than that of the second rod 12, so that the whole of the elastic member 14 is received in the receiving hole. While the thickness of the locking member 13 is larger than that of the second rod 12, and the two ends of the locking member 13 are protruded out of the two end of the second rod 12 to extend into the positioning hole 114. By means of the spring force of the elastic member 14, the locking member 13 is pushed against the first tooth surface 115 of the positioning hole 114, so that the first tooth surface 115 is maintained to engage with the second tooth surface 133.

The rotation and locking principle of the first rod 11 and the second rod 12 of the hinge 111 will be described by combining with FIGS. 7-9. For explanations and understanding well, in the following embodiment, the first rod 11 is pivotally connected relatively to the second rod 12 and can be rotated relatively to the second rod 12. But in the embodiment referring to FIG. 1, the second rod 12 can be rotated relatively to the first rod 11. Persons skilled in the art can configure the relative connection of the rods 11 and 12 after understanding their connection principle.

Under a position shown in FIG. 7, if there is a need to adjust the angle of the headrest, user turns the headrest, causing the first rod 11 to rotate clockwise relatively to the second rod 12. During the rotation, the first tooth surface 115 of the first rod 11 is engaged with the second tooth surface 133 to press the locking member 13, so that elastic member 14 is deformed due to the locking member 13, thereby the locking member 13 is moved backwards, and the first rod 11 can be rotated successfully without being locked by the locking member 13.

If the first rod 11 stops rotating, the engagement between the second tooth surface 133 and the first tooth surface 115 is maintained under the spring action of the elastic member 14. At this time, the headrest is in use and applied with force, so that the first rod 11 has a trend of rotating reversely (anticlockwise). However, the first rod 11 cannot rotate reversely because the locking member 13 engaged with the first tooth surface 115 is jammed between the second rod 12 and the first rod 11. In such a way, the headrest can be locked in this angle.

Figure 8:
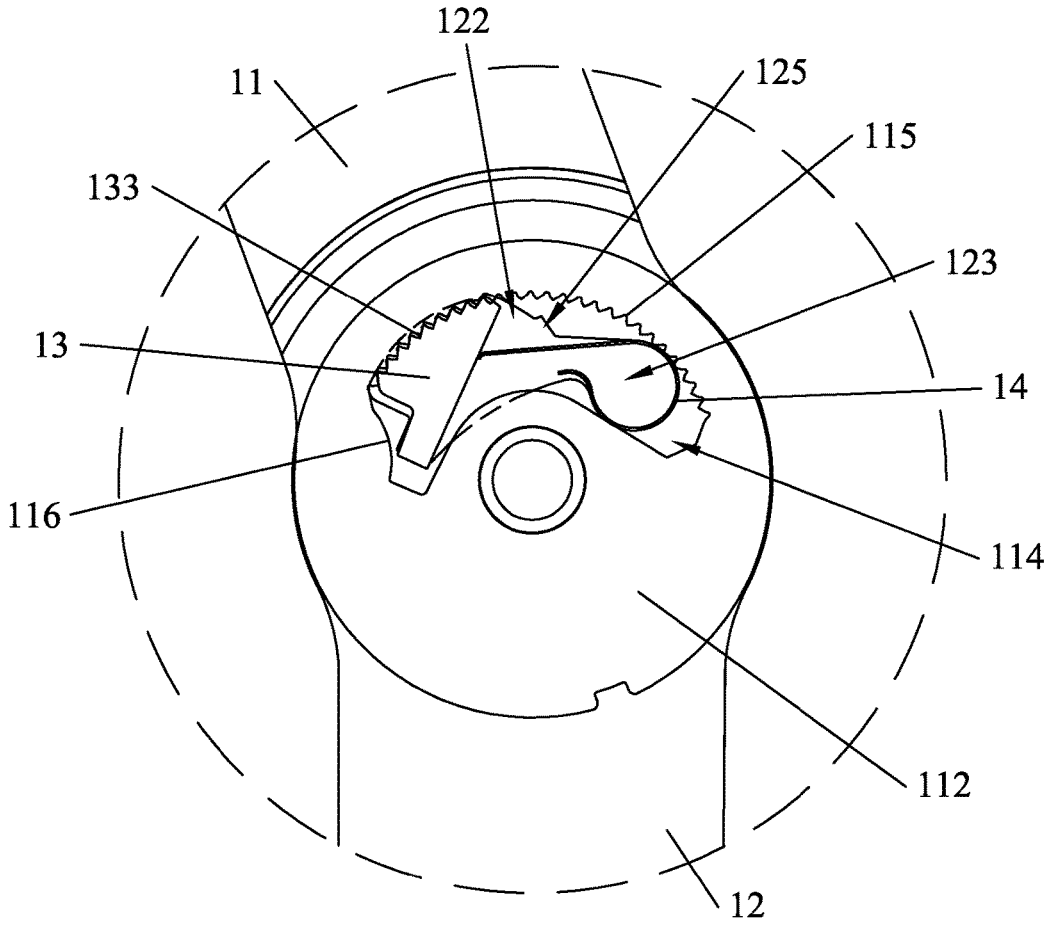
FIG. 8 is an engaging view showing that the first rod is pivoted relative to the second rod.
Figure 9:
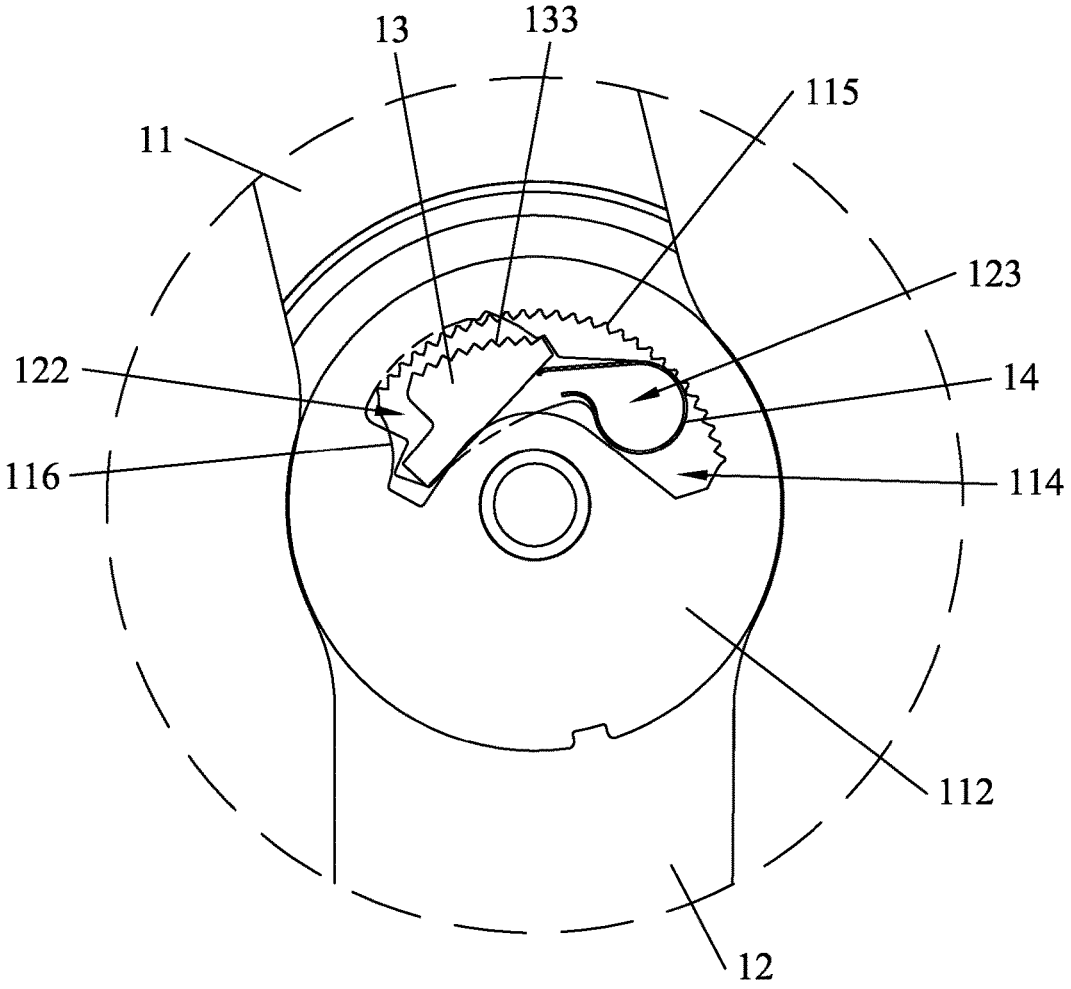
FIG. 9 is a view showing that the locking portion is slid into the unlocking portion.

If there is a need to adjust the angle of the headrest backwards, user turns the first rod 11 to reach the end position, as shown in FIG. 8. At this time, the contact surface 116 is contacted with the locking member 13. Continuing to turn the first rod 11, the locking member 13 will be raised under the pushing action of the contact surface 116, until the end of the locking member 13 slides into the unlocking position 125, as illustrated in FIG. 9. After that, the second tooth surface 133 no longer engages with the first tooth surface 115, therefore the first rod 11 is unlocked and can be reversely rotated freely. Once the first rod 11 is rotated reversely to the initial position, the inner side wall of the positioning hole 114 will push the locking member 13 out of the unlocking position 125, so that the first tooth surface 115 will be engaged with the second tooth surface 133 again. Thus the first rod 11 can be rotated clockwise to adjust the angle of the headrest.

Preferably, a power spring (not shown) is arranged between the first rod 11 and the second rod 12, one end of the power spring is fixed to the pivot 15, and another end of the power spring is fixed to a positioning post 120 formed on the second rod 12. When the locking member 13 is in the unlocking position 125, the first rod 11 is unlocked from the second rod 12, that is, the second rod 12 can be rotated to the initial position.

Figure 10:
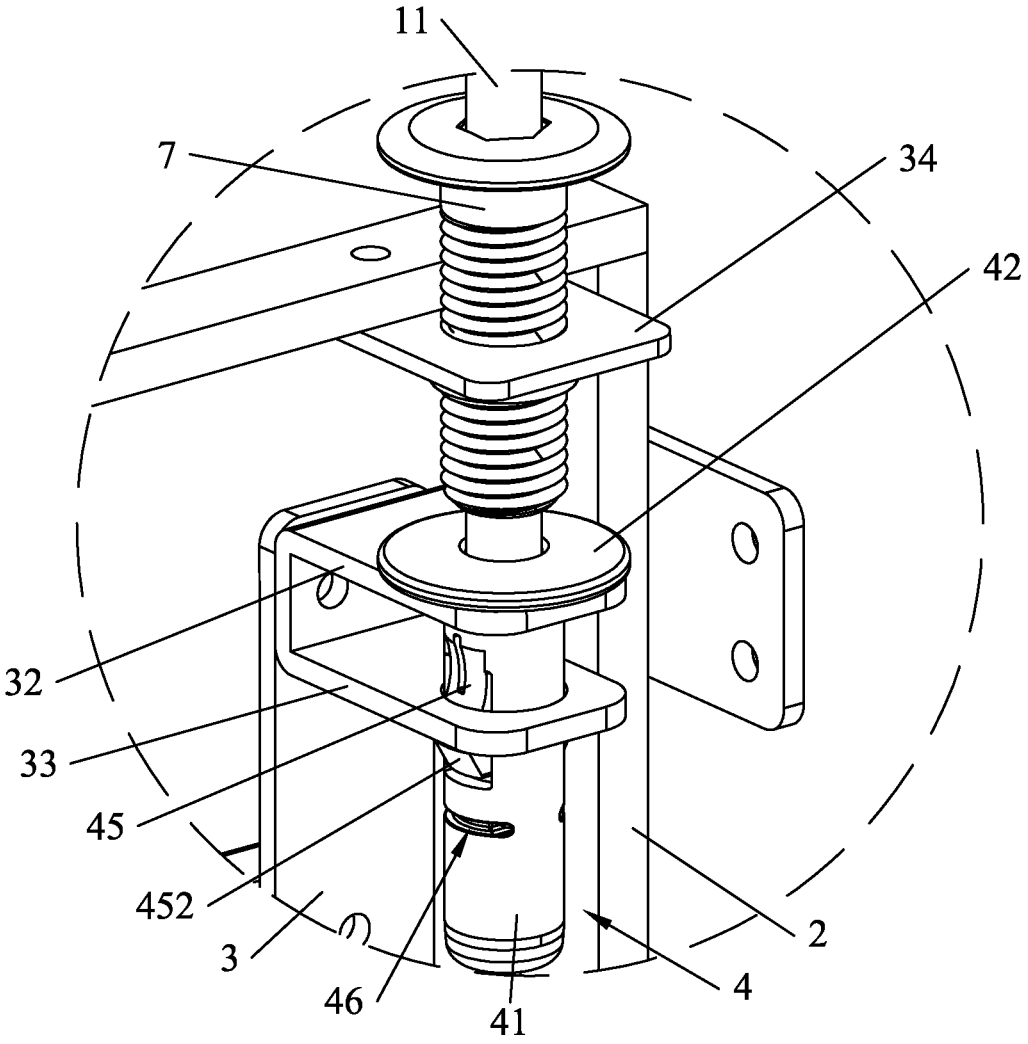
FIG. 10 is an enlarged view of A portion of FIG. 1.
Figure 11:
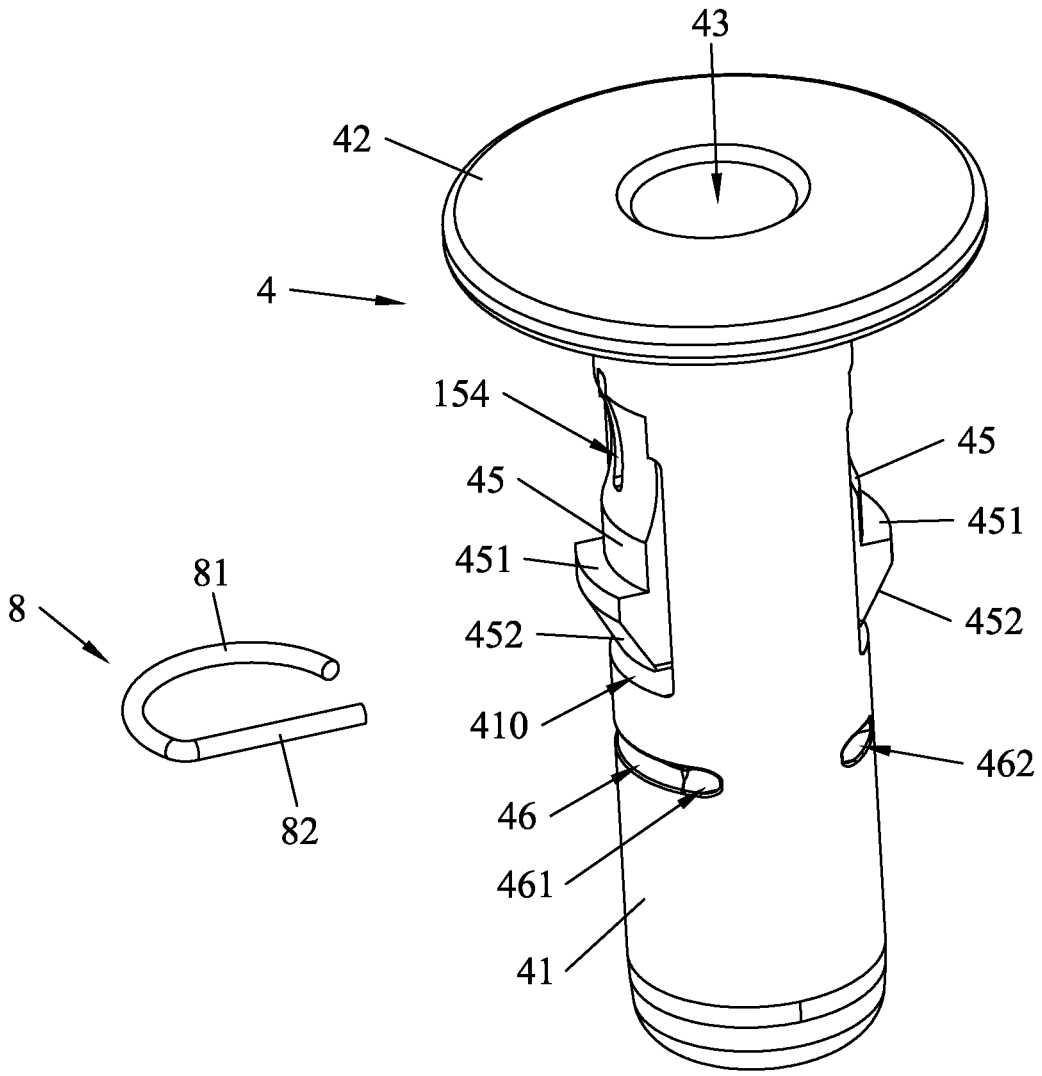
FIG. 11 is a view showing the structures of the plug bush and the snap spring.

Combining with FIGS. 10 and 11, the end of the lift mechanism 3 is provided with an upper mounting plate 32 for mounting the plug bush 4, a lower mounting plate 33 and a locking plate 34 above the upper mounting plate 32. Specifically, the upper mounting plate 32 and the lower mounting plate 33 are provided with a through hole respectively, and the locking plate 34 is provided with a screw hole. The plug bush 4 includes a main body 41 and a limiting portion 42 fixed on the top of the main body 41. The size of the main body 41 is smaller than that of the through holes of the upper mounting plate 32 and the lower mounting hole 33, so that the main body 41 can be inserted into the upper and the lower mounting plates 32, 33. While the size of the limiting portion 42 is larger than that of the through holes to support on the upper mounting plate 32. More specifically, the main body 41 is a cylinder structure, and the limiting portion 42 is a disc structure, which are integrated in a unity. An inserting slot 43 is formed through the plug bush 4 and the limiting portion 42, and extended to the bottom of the main body 41. In this embodiment, the inserting slot 43 does not pass through the main body 41, which is not limited.

As shown in FIG. 11, two hooks are oppositely configured at a side wall of the main body 41. In a normal status, the distance between the outer edges of the two hooks 45 is larger than the diameters of the through holes of the upper mounting plate 32 and the lower mounting plate 33. Once the hooks 45 are applied with force, the deformed hooks 45 can pass through the through holes. Specifically, two receiving slots 410 are oppositely configured at the side wall of the main body, the upper ends of the hooks 45 are fixed in the receiving slots 410, and the lower ends of the hooks 45 are provided with a limiting surface 451 and an inclined surface 452 beyond the receiving slots 410. More specifically, the limiting surface 451 is formed horizontally, and the inclined surface 452 is located behind the limiting surface 451. Once the inclined surface 452 is applied with force, the lower end (free end) of the hook 45 will be deformed, so that the deformed limiting surface 451 and the inclined surface 452 are pressed into the receiving slot 410.

When the main body 41 is inserted into the upper mounting surface 32 and the lower mounting surface 33, the inclined surfaces 452 of the hooks 45 will be contacted with and limited by the edge of the through hole, so that the hooks 45 are deformed to press into the receiving slots 410, in such a way, the main body 41 an the hooks 45 can pass through the upper mounting plate 32 and the lower mounting plate 33 in turns. After the hooks 45 pass through the through hole of the lower mounting plate 33, the hooks 45 are restored to the initial shape, so that the limiting surfaces 451 of the hooks 45 are opposite to or pressed against the bottom of the lower mounting surface 32, and the limiting portion 42 of the plug bush 4 is pressed against the top of the upper mounting surface 32. In such a way, the plug bush 4 is mounted on the lift mechanism 3. If the plug bush 4 is required to detach, pressing the lower ends of the hooks 45 is necessary to press the limiting surfaces 451 into the receiving slot 410, in this time, the plug bush 4 can be pulled up.

Referring to FIG. 11 again, the side wall of the main body 41 is further provided with two engaging slots 46 which are located below the hooks 45. The engaging slots 46 are extended along the outer surface of the main body 41, which are curved. Note, the engaging slots 46 do not run through the outer surface of the main body 41, thus are not communicated with the inserting slot 43. When the first rod 11 is inserted into the inserting slot 43 and pushed against the bottom wall of the inserting slot 43, the retaining groove 113 of the first rod 11 faces to the engaging slot 46, namely, the slots 113 and 46 are located at the same level. A first through hole 461 is formed on the bottom surface of the engaging slot 46 to run through the side wall of the main body 41 and communicate with the inserting slot 43, a second through hole 462 is formed through the side wall of the main body 41 to communicate with the first through hole 461. A snap spring 8 is engaged in the engaging slot 46 and extended into the inserting slot 43 to lock the first rod 11. Specifically, the snap spring 8 is a special-shaped snap spring which includes a curved section 81 which is engaged with the engaging slot 46 and a straight section 82 which is connected with the curved section 81 and inserted into the inserting slot 43 to engage with the retaining groove 113. Another end of the straight section 82 is extended into the second through hole 462. Since the snap spring 8 is arranged in the engaging slot 46 and the retaining groove 113, thus the first rod 11 can be locked in the inserting slot 43 and will be pulled from the plug bush 4 if the snap spring 8 is removed.

Preferably, a screw nut 7 is connected on the first rod 11. When the hinge 1 is mounted on the lift mechanism 3, firstly the plug bush 4 is mounted to the upper and lower mounting plates 32 and 33, and then the screw nut 7 is drilled through the locking plate 34 and screwed on the plug bush 4, finally the first rod 11 in the screw nut 7 is inserted downwards and locked by the snap spring 8.

In comparison with the prior arts, the electric push rod 5 with the slider 51 is configured on the fixed base 2 of the headrest adjusting device according to the present invention, during the assembly, the first rod 11 of the hinge 1 is connected with the slider 51, the fixed base 2 is fixed into the sofa body, and the mounting plate 9 between the two second rods 12 is fixed into the sofa body. If there is a need to separately adjust the angle of the headrest, it can be achieved by adjusting the angle between the second rod 12 and the first rod 11; if there is a need to separately adjust the height of the headrest, it can be achieved by lifting or reducing the position of the slider 51. Additionally, the hinge 1 and the electric push rod 5 can be adjusted at the same time, to simultaneously adjust the angle and the height of the headrest. By this token, by means of the headrest adjusting device according to the present invention, the angle and the height of the headrest can be adjusted independently, thereby meeting demands of the users.

In this embodiment, the height of the hinge 1 is adjusted by the electric push rod 5 by means of the lift mechanism 3, while the hinge 1 is detachably mounted to the lift mechanism 3 by means of the plug bush 4. In another embodiment, the lift mechanism 3 and the plug bush 4 can be omitted; instead, the first rod 11 of the hinge 1 is fixed to the slider 51 directly. The quantity of the hinge 1 can be one, and the second rod 12 of the hinge 1 can be fixed to the headrest directly without the mounting plate 9. The drive device in the present embodiment is an electric push rod 5, but also can be other linear drive devices such as cylinder.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A headrest adjusting device, comprising a hinge, a fixed base and a drive device, wherein the drive device is fixed on the fixed base and has an output end that is capable of sliding upwards or downwards, the hinge comprises a first rod and a second rod which are pivotally connected together, the second rod can be rotated or locked relatively to the first rod, and the first rod is driven by the output end of the drive device to move upwards or downwards, wherein a locking member and an elastic member are arranged between the first rod and the second rod, a positioning hole is provided at one end of the first rod, the positioning hole comprises a first tooth surface and a contact surface connected with the first tooth surface, the first tooth surface is in arc-shaped, a receiving hole is provided at one end of the second rod, the receiving hole comprises a first receiving hole and a second receiving hole which are communicated with one another, and a positioning slot is formed at one end of the first receiving area; the locking member comprises a retaining portion and a locking portion, the retaining portion is detachably inserted into the positioning slot to make the locking portion to swing in the first receiving area, the locking portion includes a second tooth surface extended into the positioning hole to engage with the first tooth surface, one end of the elastic member is received in the second receiving area, another end of the elastic member is pushed against the locking portion to the first tooth surface; an unlocking position is formed at a connection between the first receiving area and the second receiving area, and one end of the locking portion is pushed by the contact surface to slide into the unlocking position thereby disengaging the first tooth surface from the second tooth surface.

2. The headrest adjusting device according to claim 1, wherein a power spring is arranged between the first rod and the second rod, and the power spring pulls the second rod to rotate relatively to the first rod once the power spring is disengaged from the first tooth surface and the second tooth surface.

3. The headrest adjusting device according to claim 1, wherein the locking portion is wedge-shaped, and the retaining portion is fixed on one end of the locking portion.

4. The headrest adjusting device according to claim 1, wherein the second receiving area is circular, the elastic member is a leaf spring which has one end that is curved and received in the second receiving area and another end that is straight and extended into the first receiving area to push the locking member.

5. The headrest adjusting device according to claim 1, further comprising a lift mechanism fixed to the output end of the drive device, and one end of the first rod is installed on the lift mechanism.

6. The headrest adjusting device according to claim 5, further comprising two said hinges, and two side first rods of the hinges are respectively installed on two ends of the lift mechanism.

7. The headrest adjusting device according to claim 5, wherein the fixed base comprises a vertical guide stem, and a linear bearing is fixed on the lift mechanism and sleeves on the vertical guide stem.

8. The headrest adjusting device according to claim 5, wherein a plug bush is formed on the lift mechanism, and one end of the first rod is detachably inserted into the lift mechanism.

9. The headrest adjusting device according to claim 8, wherein the lift mechanism is provided with a screw hole located above the plug bush, and a screw nut is provided at the first rod to connect with the screw hole and press against the plug bush.

* * * * *